US006645552B1

(12) United States Patent
Schall et al.

(10) Patent No.: US 6,645,552 B1
(45) Date of Patent: Nov. 11, 2003

(54) METHOD OF IMPROVING THE DRYING TIME OF A THICK COATING

(75) Inventors: Donald Craig Schall, Lansdale, PA (US); Jeffrey Joseph Sobczak, Coatesville, PA (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 09/723,065

(22) Filed: Nov. 27, 2000

Related U.S. Application Data

(60) Provisional application No. 60/168,820, filed on Dec. 3, 1999.

(51) Int. Cl.[7] ..... B05D 1/36

(52) U.S. Cl. ..... 427/137; 427/136; 427/202; 427/203; 427/385.5; 427/393.6; 427/407.1

(58) Field of Search ..... 427/407.1, 385.5, 427/393.6, 136, 203, 202, 137

(56) References Cited

U.S. PATENT DOCUMENTS

| | | | | |
|---|---|---|---|---|
| 4,186,225 A | * | 1/1980 | Smith et al. | 118/313 |
| 5,804,627 A | | 9/1998 | Landy et al. | |
| 5,824,734 A | | 10/1998 | Yang | |
| RE36,042 E | | 1/1999 | Landy et al. | |
| 5,922,398 A | | 7/1999 | Hermes et al. | |
| 5,947,632 A | | 9/1999 | Pirotta et al. | |

FOREIGN PATENT DOCUMENTS

| | | | |
|---|---|---|---|
| EP | 0 066 108 | | 12/1982 |
| EP | 0 322 188 | | 6/1989 |
| EP | 0 791 637 A2 | * | 8/1997 |
| EP | 0794 018 A2 | * | 9/1997 |

* cited by examiner

*Primary Examiner*—Shrive P. Beck
*Assistant Examiner*—Kirsten Crockford Jolley

(57) ABSTRACT

A method is disclosed of improving the drying time of a thick, exterior, waterborne coating containing a quick-setting binder by applying the coating as at least two separate layers and as "wet-on-wet" layers.

3 Claims, No Drawings

METHOD OF IMPROVING THE DRYING TIME OF A THICK COATING

CROSS REFERENCE TO RELATED PATENT APPLICATIONS

This is a nonprovisional application of prior pending U.S. provisional application Ser. No. 60/168,820 filed Dec. 3,1999.

This invention relates to a method of improving the drying time of a thick, aqueous coating. More particularly, this invention relates to a method of improving the drying time of a thick, aqueous coating containing a quick-setting binder by applying the coating as at least two separate layers.

Coatings may be applied as a thick layer (i.e., a wet thickness of at least 0.4 mm) to improve durability and to improve certain properties including sound dampening, insulating, and hiding and protecting the underlying substrate. Typically, applications where thick coatings may be needed include roof coatings and road-marking or traffic paints. One of the drawbacks of applying a thick coating is that the drying time is too long. This is particularly problematic for exterior coating applications where temperature and humidity are variable and the weather is unpredictable. Further exacerbating this problem is the need in such applications as road-marking paints to permit traffic to pass over the freshly-painted marking in as short a period of time as practicable.

The coating industry is replete with chemistries and methods for accelerating the drying time of products used in such exterior, thick coatings. A number of products utilize solvent-based fast-drying coatings. Low-boiling volatile organic solvents evaporate rapidly after application of the coating on the road to provide the desired fast drying characteristics of a freshly applied road marking. However, in addition to releasing volatile organic solvents into the environment, this type of paint formulation tends to expose the workers to the vapors of the organic solvents. Because of these shortcomings and increasingly stringent environmental mandates from governments and communities, it is highly desirable to develop more environmentally-friendly coatings while retaining fast drying properties and/or characteristics.

Much effort has been directed to developing aqueous or waterborne coating systems. Primarily due to a combination of high boiling point, high latent heat of vaporization, high polarity, and strong hydrogen bonding of water, drying times of waterborne coatings are generally longer than those exhibited by the organic solvent-based coatings. The drying time strongly depends on the relative humidity of the atmosphere in which the coatings are applied. An aqueous paint may take several hours or more to dry in high humidity. The problem of retarded drying rate is especially aggravated for more thickly applied traffic paint. Long drying times severely limit the desirability of using aqueous paints, particularly traffic paints and road marking paints because of longer traffic disruptions.

In an attempt to produce aqueous coatings with shorter drying times, i.e., fast or quick drying or setting coatings, methods utilizing salt, or acid, or combinations thereof to induce coagulation have been devised, as have pH sensitive binder systems. Such coatings include those disclosed in the following published patent applications and granted patents:

(a) EP-A-0,066,108 discloses an aqueous road marking composition in which the binder is a mixture of a pure acrylic resin, a carboxylated styrene/dibutyl fumarate copolymer and a polymeric, polyfunctional amine such as polypropylene imine.

(b) EP-B-0,322,188 discloses aqueous coating compositions containing film forming latex polymer, weak base-functional synthetic latex polymer and volatile base.

(c) EP-B-0,409,459 discloses an aqueous coating composition including an anionically stabilized emulsion polymer having Tg no lower than 0° C., a polyamine functional polymer, and a volatile base in an amount such that the composition has a pH where substantially all of the polyamine functional polymer is in a non-ionic state, and wherein more than 50% by weight of the polyamine functional polymer will be soluble at pH values of 5 to 7 on evaporation of the volatile base. In the non-ionic state (i.e., deprotonated), polyamine interaction with the anionically stabilized emulsion and any other anionic ingredients which may be present in the composition is eliminated. The volatile base must be volatile enough to be released under air drying conditions. In the absence of the volatile base, the protonated amine moieties interact with the anionic ingredients to destabilize the coating composition.

(d) U.S. Pat. No. 5,804,627 discloses methods of producing fast drying coatings on exterior surfaces that include applying on those surfaces an aqueous composition including an anionically stabilized emulsion polymer having a Tg greater than about 0° C., a polyamine functional polymer having from about 20% to about 100% of the monomer units by weight containing an amine group, and an amount of volatile base sufficient to raise the pH of the composition to a point where essentially all of the polyamine functional polymer is in a non-ionic state, and evaporating the volatile base to produce the coating.

(e) U.S. Pat. No. 5, 922,398 discloses waterborne coating compositions containing latex particles having pendant amine-functional groups. The latex particles have Tg greater than about 0° C. and are capable of film formation at application temperatures. An amount of base (e.g., ammonia) is added to raise the pH of the composition to a point where essentially all of the amine functional groups are in a non-ionic state. Upon formation of a film, the base evaporates, allowing the pendant amine moieties to become protonated. The resultant pendant ammonium moieties then interact with anionic surfactants to destabilize the aqueous system and, thereby, speed drying.

(f) U.S. Pat. No. 5,824,734 discloses a waterborne coating composition including an amine functional latex polymer having 0.1 to 5% by weight, based on solid weight of polymer, of a secondary or tertiary amino acrylate, a crosslinking monomer, and less than 5% by weight of hydrophilic monomers. The composition also includes mineral pigments. The amine functional latex polymer is prepared at pH of at least 7. Following polymerization, the pH is adjusted upward, preferably to between 8 and 9.5, to maintain the stability of the system. Upon reducing the pH, the stability of the dispersion of polymer particles and mineral pigment particles is decreased, leading to precipitation of the polymer and mineral particles and drying.

(g) U.S. Pat. No. 5,947,632 discloses waterborne coating compositions including a number of general categories of materials including talc, hollow sphere polymer, a solid polymer (e.g., ion exchange resin beads in acid, sodium or potassium form) and inorganic compounds (e.g., inorganic superabsorbent gel, Sumica gel). These materials share the characteristic that they speed the drying of coatings when applied either in the same first step with the waterborne binder, or in a subsequent step.

There is, however, a continuing need for improved methods, particularly those at minimal expense which accelerate the drying time of thick, exterior, aqueous coatings.

Statement of the Invention

This invention is directed to a method of improving the drying time of a coating, including the steps of:

(a) preparing an aqueous coating formulation containing a quick setting binder;

(b) applying a first portion of the coating formulation to a substrate to form a first wet coating;

(c) applying at least one second portion of the coating formulation to the first wet coating before the first wet coating has dried to form at least one second wet coating; and (d) permitting the first wet coating and the at least one second coating to dry;

wherein the total thickness of the first wet coating and the at least one second coating is 0.4 mm to 5.0 mm, preferably 0.5 mm to 2.5 mm and most preferably 0.6 mm to 1.5 mm.

In one embodiment of the invention, the method employs a first portion at a level of 25% to 75% by weight, based on the weight of the total coating formulation.

In another embodiment of the invention, the method employs at least one second portion that is a single application and is 25% to 75% by weight, based on the weight of the total coating formulation.

In a preferred embodiment of the invention, the method employs a first portion at a level of 50% by weight, based on the weight of the total coating formulation, and a single second portion at a level of 50% by weight, based on the weight of the total coating formulation.

In a more preferred embodiment of the invention, the method further includes a step of applying an absorber to the substrate before or after the application of the first wet coating, including before or after the application of any second or subsequent coating.

As used herein, the term "aqueous" means a composition containing greater than 60% by weight, preferably 70% by weight and most preferably 80% by weight, based on the total weight of the composition, of water as the vehicle for the coating formulation. Thus, coating formulations containing up to 40% by weight of an organic solvent are within the scope of the definition.

As used herein, the term "road" is used as a generic term and includes any indoor or outdoor solid surface which is or may be exposed to pedestrians, moving vehicles, tractors, or aircrafts continuously, constantly or intermittently. Some non-limiting examples of a "road" include highways, streets, driveways, sidewalks, runways, taxiing areas, tarmac areas, parking lots, rooftops, indoor floors (such as factory floors, inside a shopping mall), and others. The surface material may be masonry, tar, asphalt, resins, concrete, cement, stone, stucco, tiles, wood, polymeric materials and combinations thereof.

The method of the present invention may be used for improving the drying time of traffic paints, road markings, house paints, maintenance coatings for exterior or interior surfaces of buildings, walls, roofs, and other structures. The surface of the substrate may be wood, metal (such as aluminum, steel and others) polymers, plaster and others. Other applications include coating metal substrates present in a wide variety of manufactured articles such as signs, boats and cars. All of the substrates may already have one or more layers of existing coating or paint which may be fresh or aged.

The coating formulation may be applied to the surface of a substrate by a number of ways known to those having ordinary skill in the art. Some examples are brushing, spraying, extrusion, dipping and combinations thereof.

The coating formulations useful in the method of the present invention require the presence of a quick-setting binder. A number of these quick-setting binders are known in the art as were discussed previously. Suitable quick-setting binders include:

(a) an aqueous dispersion including:
- (i) an anionically stabilized polymer having Tg of at least −10° C.;
- (ii) a polyamine functional polymer formed from either amine or imine monomer; and
- (iii) a volatile base in an amount sufficient to deprotonate the conjugate acid of the polyamine functional polymer;

(b) an aqueous dispersion including:
- (i) a polyamine functional polymer that is a latex polymer having pendant amine-functional groups, wherein such latex polymer has a Tg of at least −10° C.; and
- (ii) a volatile base in an amount sufficient to deprotonate the conjugate acid of said polyamine functional polymer;

(c) an aqueous dispersion including:
- (i) a polyamine functional polymer that is a latex polymer having pendant amine-functional groups and pendant acid-functional groups,
  - wherein the ratio of amine-functional groups to acid-functional groups is greater than 3 to 1, and
  - wherein said latex polymer has a Tg of at least −10° C.; and
- (ii) a volatile base in an amount sufficient to deprotonate the conjugate acid of said polyamine functional polymer;

(d) an aqueous dispersion including:
- (i) a polyamine functional polymer that is a latex polymer having pendant amine-functional groups,
  - wherein said latex polymer having pendant amine-functional groups has a Tg of at least −10° C.;
- (ii) a latex polymer having pendant acid-functional groups,
  - wherein said latex polymer having acid-functional groups has a Tg of at least −10° C.; and
- (iii) a volatile base in an amount sufficient to deprotonate the conjugate acid of said polyamine functional polymer;

(e) an aqueous dispersion including:
- (i) an aqueous emulsion containing a polyamine functional polymer, having a Tg of at least −10° C., formed from polymerizable monomers including:
  - (A) alkyl esters of acrylic or methacrylic acid having an alkyl ester portion containing between 1 to 18 carbon atoms;
  - (B) from 0.1 to 5% by weight, based on said acrylic film forming polymer, of at least one secondary or tertiary aminoacrylate monomer, or secondary or tertiary aminomethacrylate monomer; and (C) from 0.1 to 5% by weight, based on the acrylic film forming polymer of crosslinkable monomer selected from the group consisting of acrylamide, methacrylamide, and N-alkylol acrylamide; and said polyamine functional polymer having less than 3 percent by weight, based on said film forming polymer of hydrophilic monomer incorporated therein; and (ii) volatile base in an amount sufficient to deprotonate the conjugate acid of said polyamine functional polymer;

(f) a composition including:

(i) an aqueous dispersion including polymer having pendant strong cationic groups, wherein said polymer having pendant strong cationic groups has a Tg of at least −10° C.; and (ii) an aqueous dispersion including a polymer having pendant weak acid groups, wherein the polymer having pendant weak acid groups has a Tg equal to or greater than −10° C.; and (g) an aqueous dispersion including a polymer having both pendant strong cationic groups and pendant weak acid groups, wherein the polymer has a Tg of at least −10° C.

In addition to the quick-setting binder, the coating formulation may optionally contain an absorber that further accelerates the drying of the coating. Suitable absorbers include organic super absorbent polymers, ion-exchange resins, hollow sphere polymers, molecular sieves, talcs, inorganic absorbers such as inorganic superabsorbent gel and Sumica gel, porous carbonaceous materials, non-porous carbonaceous materials, and mixtures thereof.

The level of absorber used in the present invention is in the range of from 0.01% by weight to 90% by weight, based on the total weight of the quick-setting binder. A preferred range is from 0.1% by weight to 70% by weight, more preferably from 1% by weight to 30% by weight.

The coating formulation may also contain conventional coating components, especially those used in thick, exterior coating applications, including, but not limited to, thickeners; rheology modifiers; dyes; sequestering agents; biocides; dispersants; pigments, such as, titanium dioxide, organic pigments, carbon black; extenders, such as, calcium carbonate, talc, clays, silicas and silicates; fillers, such as glass or polymeric microspheres, quartz and sand; anti-freeze agents; plasticizers; adhesion promoters such as silanes; coalescents; wetting agents; surfactants; slip and anti-skid additives; crosslinking agents; defoamers; colorants; tackifiers; waxes; preservatives; freeze/thaw protectors; corrosion inhibitors; and anti-flocculants.

All ranges disclosed herein are inclusive and the minimums and maximums of the nested ranges are combinable.

EXAMPLES

A paint formulation was prepared in accordance with Table I.

TABLE I

Paint Formulation A

| Components | Paint Formulation A (g) |
|---|---|
| FASTRACK ™ 2706 quick-setting hinder from Rohm and Haas Company, Philadelphia, PA (disclosed in EP-B-0,409,459) | 460.1 |

TABLE I-continued

Paint Formulation A

| Components | Paint Formulation A (g) |
|---|---|
| TAMOL ™ 901 (30%) dispersant (ammonium salt of a polyelectrolyte) from Rohm and Haas Company, Philadelphia, PA | 7.2 |
| SURFYNOL ™ CT-136 acetylenic surfactant from Air Products and Chemicals, Inc., Allentown, PA | 2.8 |
| DREWPLUS ™ L-493 defoamer from Ashland Chemical Company, Drew Industrial Division, Boonton, NJ | 2.0 |
| TI-PURE ™ R-900 titanium dioxide from E. I. duPont de Nemours & Company, Wilmington, DE | 100.0 |
| OMYACARB ™ -5 calcium carbonate from Pluess-Staufer Industries, Inc., Proctor, VT | 760.6 |
| After 15 minutes, add | |
| Methanol | 30.0 |
| TEXANOL ® solvent ester alcohol from Eastman Chemicals, Kingsport, TN | 23.0 |
| DREWPLUS ™ L-493 defoamer from Ashland Chemical Company, Drew Industrial Division, Boonton, NJ | 3.5 |
| NATROSOL ® 250HR(2%) thickener from Hercules Inc. | 7.0 |
| Water | 11.6 |
| Total weight (g) | 1407.8 |

Paint Formulation A was evaluated using several different application methods. The drying time of each method was measured in following manner:

(1) applying 4-inch (0.1016 m) wide lines of each paint formulation to a specified wet film thickness over existing traffic markings;

(2) optionally, applying a subsequent portion of each paint formulation over the first portion applied while previous portion is wet (repeat this step for number of applications desired);

(3) at a specified time interval, driving a Ford Model F-350 pickup truck at about 20 mph (32 km/hour) over the lines;

(4) examining the surrounding road surface for white paint that was picked up by the truck tires and deposited elsewhere on the road surface; and (5) indicating the time indicated when there was very little or no paint deposited on the road ("Time-to-No-Tracking").

The conditions and results are shown in Table II.

TABLE II

Evaluation of Paint Formulation A

| Coating Method | First Portion of Coating Formulation A | Second Portion of Coating Formulation A† | Total coating thickness | Absorber | Dry to No Tracking Time |
|---|---|---|---|---|---|
| 1 (Comparative) | 0.762 mm (wet) 100% | — — | 0.762 mm (wet) | none | 4 minutes |
| 2 | 0.381 mm (wet) 50% | 0.381 mm (wet) 50% | 0.762 mm (wet) | none | 2 minutes |
| 3 (Comparative) | 0.762 mm (wet) 100% | — — | 0.762 mm (wet) | ion exchange resin* | 1.5 minutes |

TABLE II-continued

Evaluation of Paint Formulation A

| Coating Method | First Portion of Coating Formulation A | Second Portion of Coating Formulation A† | Total coating thickness | Absorber | Dry to No Tracking Time |
|---|---|---|---|---|---|
| 4 | 0.381 mm (wet) 50% | 0.381 mm (wet) 50% | 0.762 mm (wet) | ion exchange resin* | 0.5 minutes |

†Applied about 0.5 seconds after first portion applied ("wet-on-wet")
*Amberlite IR 120H ion exchange resin at 150 g/m$^2$ (applied between the first and second coating portions) available from Rohm and Haas Company, Philadelphia, PA We have unexpectedly discovered that drying time is significantly reduced by applying two separate coatings of paint ("wet-on-wet"), compared to a single coating of paint at the same total wet film thickness [Method 2 v. Method 1 (Comparative) and Method 4 v. Method 3 (Comparative)].

We claim:

1. A method of preparing an exterior coating, said method comprising the steps of:

(a) preparing a waterborne coating formulation containing a quick-setting binder, (i) an anionically stabilized polymer having Tg of greater than −10° C.;

(ii) a polyamine functional polymer formed from amine monomer or imine monomer; and (iii) a volatile base in an amount sufficient to deprotonate the conjugate acid of said polyamine functional polymer;

(b) applying a first portion of said coating formulation to a substrate to form a first wet coating;

wherein said first portion is 25% to 75% by weight, based on the weight of said total coating formulation;

(c) applying at least one second portion of said coating formulation to said first wet coating before said first wet coating has dried to form at least one second wet coating;

wherein said at least one second portion is a single application and is 25% to 75% by weight, based on the weight of said total coating formulation; and (d) permitting said first wet coating and said at least one second coating to dry;

wherein the total thickness of said first wet coating and said at least one second wet coating is 0.4 mm to 5.0 mm.

2. The method of claim 1, wherein said first portion is 50% by weight, based on the weight of the total coating formulation, and wherein said at least one second portion is 50% by weight, based on the weight of the total coating formulation.

3. The method of claim 1, further comprising the step applying an absorber to said substrate before or after the application of said first wet coating, wherein said absorber is selected from the group consisting of ion exchange resin, hollow sphere polymer, molecular sieve, talc, inorganic superabsorbent gel, Sumica gel, porous carbonaceous material, non-porous carbonaceous material, and mixtures thereof.

* * * * *